US006882243B2

(12) United States Patent
Kummer et al.

(10) Patent No.: US 6,882,243 B2
(45) Date of Patent: Apr. 19, 2005

(54) DIRECTIONAL COUPLER

(75) Inventors: Bernhard Kummer, Kolbermoor (DE); Rainer Krause, Kiefersfelden/Mühlbach (DE)

(73) Assignee: Kathrein-Werke KG, Rosenheim (DE)

( * ) Notice: Subject to any disclaimer, the term of this patent is extended or adjusted under 35 U.S.C. 154(b) by 20 days.

(21) Appl. No.: 10/455,802

(22) Filed: Jun. 6, 2003

(65) Prior Publication Data

US 2004/0005814 A1 Jan. 8, 2004

(30) Foreign Application Priority Data

Jun. 27, 2002 (DE) ..... 102 28 851

(51) Int. Cl.[7] ..... H01P 5/12
(52) U.S. Cl. ..... 333/115; 333/33
(58) Field of Search ..... 333/115, 109, 333/113, 116; 324/95

(56) References Cited

U.S. PATENT DOCUMENTS

| | | | | |
|---|---|---|---|---|
| 4,211,911 A | | 7/1980 | Dehn | |
| 4,476,447 A | | 10/1984 | Lauchner | |
| 4,891,612 A | * | 1/1990 | Gleason et al. | 333/33 |
| 5,432,485 A | | 7/1995 | Nagashima | |
| 5,508,630 A | | 4/1996 | Klemer et al. | |
| 5,994,983 A | * | 11/1999 | Andersson | 333/246 |

FOREIGN PATENT DOCUMENTS

| | | |
|---|---|---|
| DE | 23 220 458 C2 | 11/1974 |
| DE | 23 50 156 C2 | 4/1975 |
| DE | 691 21 644 T2 | 12/1991 |
| DE | 199 28 943 A1 | 3/2000 |

OTHER PUBLICATIONS

Mylvaganam, KS, "Coaxial Line to Stripline Directional Coupler," IEE Proceedings H. Microwaves, Antennas & Rpopagation, Institution of Electrical Engineers, Stevenage, GB, Bd. 134, Nr. 2 (Apr. 1987).

* cited by examiner

*Primary Examiner*—Brian Young
*Assistant Examiner*—Joseph Lauture
(74) *Attorney, Agent, or Firm*—Nixon & Vanderhye P.C.

(57) ABSTRACT

An improved directional coupler is distinguished by the following features:

an attenuation circuit is adjacent and is connected to each of the two coupling line ends on the coupler substrate, or an attenuation circuit is connected to one coupling line end with a terminating resistor (49) being connected to the other coupling line end on the coupler substrate, electrical level evaluation is provided on the coupler substrate, and an interface device for connection of possibly unshielded cables is provided on the coupler substrate, or possibly unshielded cables are connected to the level evaluation circuit device or are connected downstream from this on the coupler substrate, via which the RF signals which are obtained via the coupling line piece can be passed on in the form of analog signals.

13 Claims, 5 Drawing Sheets

DIRECTIONAL COUPLER

BACKGROUND OF THE INVENTION

The invention relates to a directional coupler.

A directional coupler has been disclosed, for example, in DE 23 20 458 C2. This comprises an asymmetric stripline and a coaxial line, and the stripline in this directional coupler is coupled to the coaxial inner conductor. The strip conductor is in this case fitted in the coupling zone into an exposed cutout in the outer conductor of the coaxial line, with the ground conductor of the stripline at the same time forming the shield (which is interrupted by the cutout) of the coaxial line.

A directional coupler which is to this extent comparable to this prior art has also been disclosed in DE 199 28 943 A1. In order to provide inductive coupling as well in a directional coupler such as this, this prior publication proposes that the base plate be in the form of a circular substrate wafer which is seated in an appropriately cylindrical milled-out area. The angle of the substrate wafer can thus be rotated with the coupling piece.

The directional coupler can thus be tuned by rotating the coupling line in the electromagnetic coaxial cable field. However, the tuning is in this case restricted just to the coupling loss. The achievement of a high degree of directionality, as is of major importance in practice, plays no role in this solution.

The directional coupling signal variables which are tapped off in the cited prior art are supplied in a known manner to an external evaluation device, to be precise via coaxial cables. Since radio-frequency signals are emitted, high-quality and costly coaxial cables must therefore also be used, in the same way as high-quality and costly coaxial plug connectors as well, of course. The aim of this is to ensure that a high-quality connection and thus good directionality can also be achieved, with respect to the characteristic impedance.

Equally, only comparatively poor directionality levels can be achieved with the known directional couplers.

Against the background of the prior art in this field, the object of the present invention is thus to provide an improved directional coupler which allows better signal values to be achieved with the design whose cost is lower overall.

BRIEF SUMMARY OF THE INVENTION

In contrast to the prior art in its entirety, the invention now proposes that an attenuation circuit be provided on the base plate of the directional coupler, adjacent to each of the two ends of the coupling piece, or that an attenuation circuit be provided at one end of the coupling piece with a terminating resistor being provided at the other end of the coupling piece. If a terminating resistor is provided at one end of the coupling piece, then this is a so-called single-armed directional coupler, in which the second coupling arm is terminated by the terminating resistor.

However, electronic level evaluation is provided, in particular, on the directional coupler itself, that is to say preferably on the base plate. An interface device is also fitted, to which, however, only one unshielded cable can then be connected—since the radio-frequency signal processing takes place on the directional coupler itself. Specifically, a flat ribbon cable is preferably connected to this interface device and, of course, this can be provided at a considerably lower cost than high-quality coaxial cable connections.

This configuration according to the invention not only results in major cost advantages over conventional solutions, but also results in considerably better directionality values!

In one preferred embodiment of the invention, a Π circuit, which is known per se, or, for example, a T circuit using appropriate resistors is used for the attenuation elements. In particular, these circuit arrangements can be fitted without any problems to the base plate or to the directional coupler.

Furthermore, filter modules may also be accommodated on the respective arm of the directional coupler.

It has also been found to be particularly advantageous for a level detector to be accommodated on the directional coupler, that is to say in particular on the base plate.

Finally, one development of the invention proposes that a nonvolatile EEPROM memory module also be located on the directional coupler, and that this be used to store the transfer function of at least one, and preferably both coupling arms together with an electronic evaluation. This now ensures a unique association between the RF level value that is present and the resultant detector voltage. All the component tolerances for the directional coupler and the evaluation electronics are thus combined and stored in a common assembly. Furthermore, this also makes it considerably easier to replace individual assemblies in a unit. This is because, in the coupler systems which have already been disclosed, it was in contrast necessary either to carry out complex matching on the overall unit after replacement of individual components, or to use very high-quality, narrow-tolerance individual components, whose interaction did not require any matching.

BRIEF DESCRIPTION OF THE DRAWINGS

The invention will be explained in more detail in the following text with reference to drawings in which, in detail.

DESCRIPTION OF THE PREFERRED EMBODIMENTS

Figure 1:
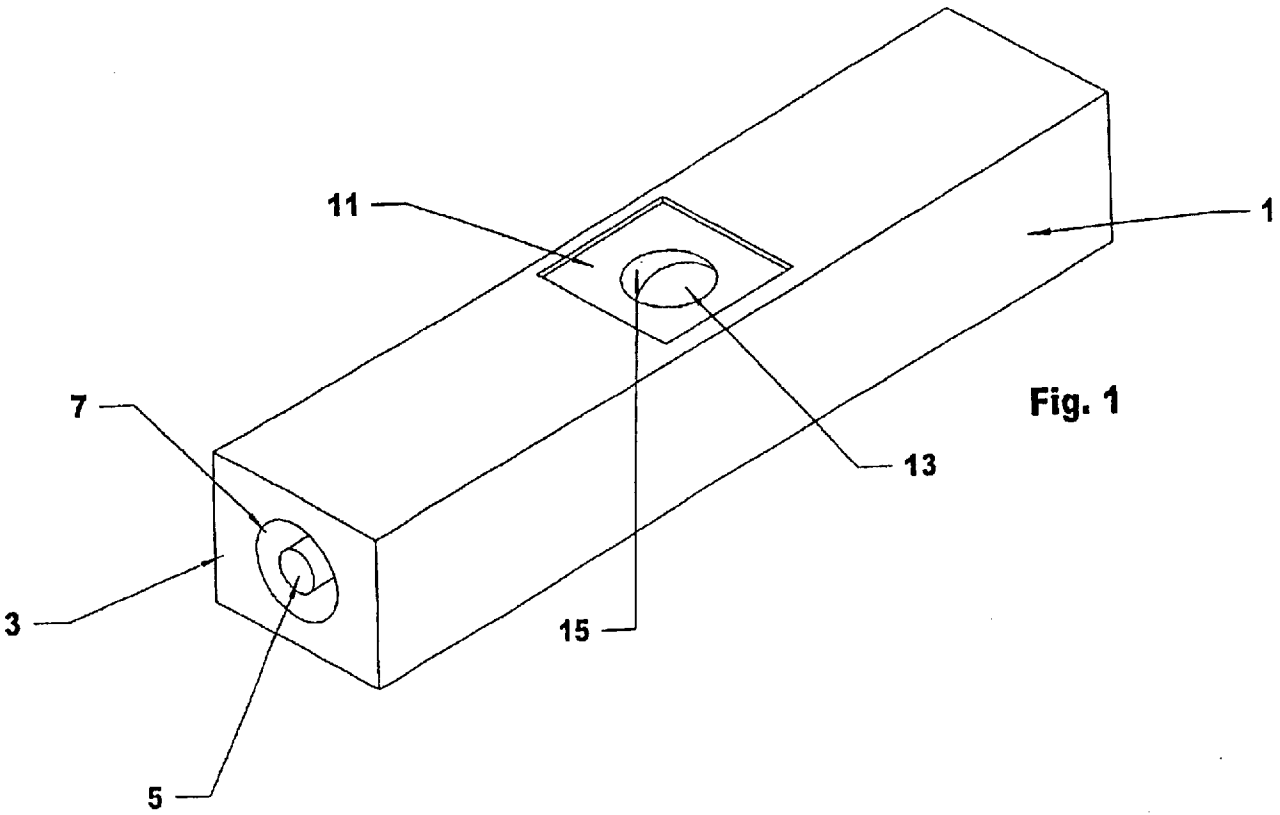
FIG. 1: shows a schematic perspective illustration of a coaxial conductor with a connecting region for the directional coupler.
Figure 2:
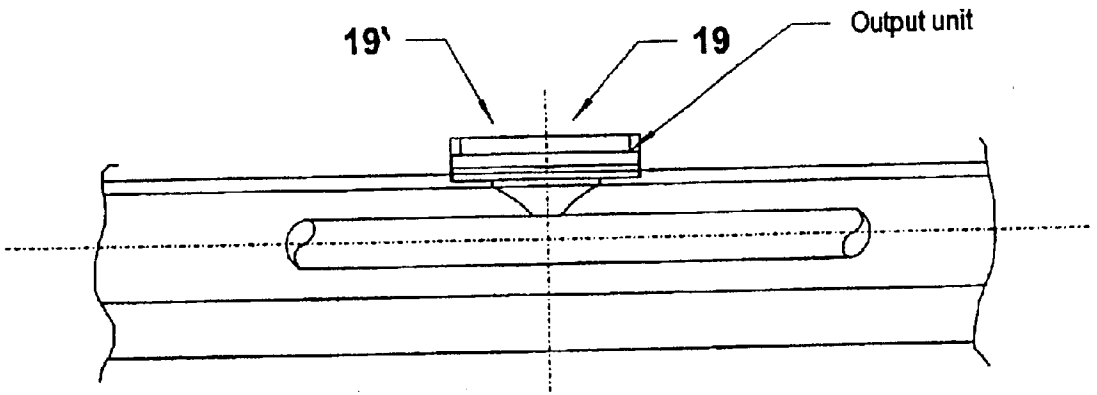
FIG. 2: shows a schematic vertical sectional illustration through the base plate of the directional coupler and of the coaxial conductor.
Figure 3:
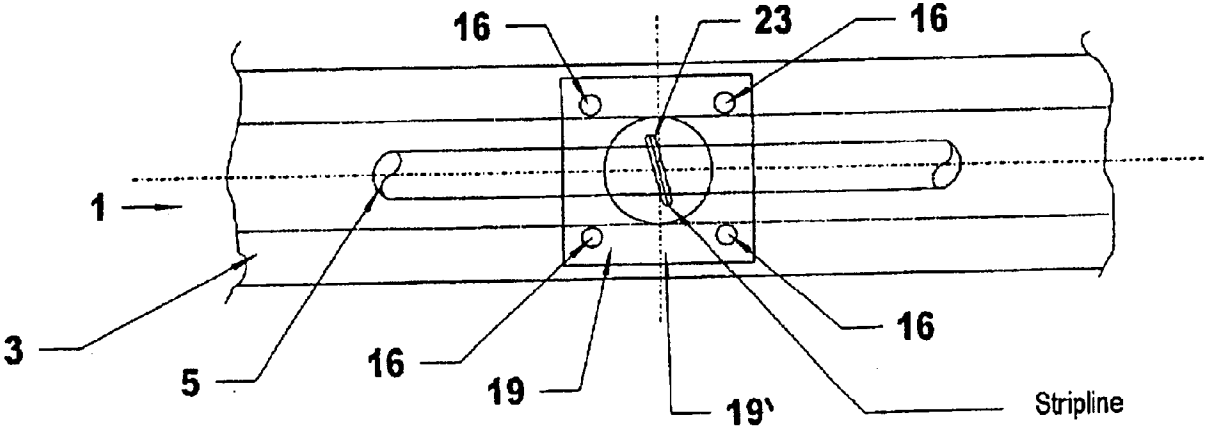
FIG. 3: shows a schematic plan view of the illustration shown in FIG. 2.

FIG. 1 et seq. show a directional coupler which comprises a continuous coaxial line piece 1 with an outer conductor 3, which is illustrated in a perspective view and has a relatively bulky form in FIG. 1, and with an inner conductor 5.

In the illustrated exemplary embodiment, the outer conductor 3 has a square or rectangular external shape. The inner conductor 5, which is cylindrical in the illustrated exemplary embodiment, is provided such that it runs electrically isolated from the outer conductor 3, forming a hollow-cylindrical separation area 7 in the interior of the outer conductor 3.

As can be seen in particular in FIG. 1, a resting or mounting section 11, preferably in the form of a depression or a milled-out area, is provided on the outer conductor 3. An exposed cutout 15, that is to say a window 15, is provided in the wall of the outer conductor 3 in a coupling zone 13 that is formed in this way.

The coupler 19 together with the coupler substrate 19' is then firmly mounted on the outer conductor 3 in this coupling zone 13, for example by means of two or more screws 16 located in laterally offset positions with respect to the exposed cutout 15, with a coupling line piece 23 being provided on the lower face of the coupler substrate 19'. In this case, the coupling line preferably has a length of $<\lambda/4$, in particular a length of $>\lambda/16$, and especially around $\lambda/8$. For this purpose, appropriate threaded holes are incorporated in the wall of the outer conductor 3 at the points at which the screws 16 are located, and are aligned with corresponding holes 18 in the coupler substrate 19' in order to screw in the appropriate screws 16.

The coupling line piece 23 may be provided in a predetermined alignment on the coupler substrate 19', to be precise so as to achieve coupling loss levels that are advantageous base on experience.

The coupling line piece 23 may, for example, be formed from a stripline. However, a wire clip or a wired component (resistor) may be used just as well.

The coupler substrate 19' is in the form of a multilayer structure whose shielding surface offers good shielding, thus resulting in a coupler which is resistant to interference radiation overall. The multilayer structure 19' thus once again completely closes the shield for the coaxial line, which is interrupted by the exposed cutout 15.

The signals which are tapped off on the coupling line piece 23 in the relevant electromagnetic field are passed via through-plated holes to the upper face of the coupler, where the electronic components are located which convert the emitted RF signals directly to analog AF voltages for further processing.

For this purpose, attenuation elements or attenuation circuits 27 of suitable size are provided immediately adjacent to the coupling line ends 25, are used for forced matching for the coupling line at both ends and thus fundamentally also govern the directionality of the coupler.

Figure 5:
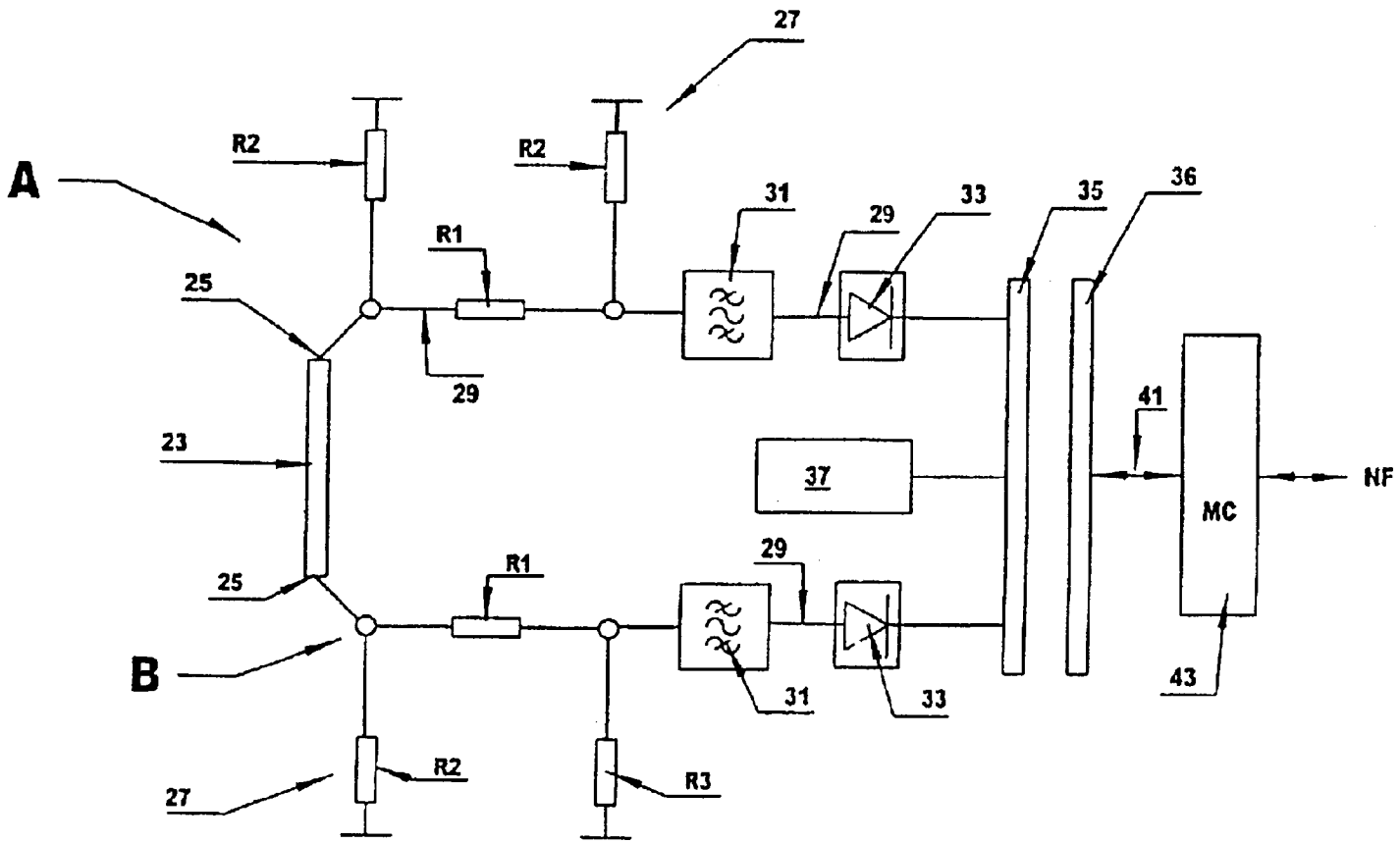
FIG. 5: shows a schematic circuit diagram to illustrate the electronics that are located on the base plate.

In the exemplary embodiment illustrated in FIG. 5, the attenuation circuit 27 is in this case in the form of a Π circuit, in which a first resistor R1 is in each case connected in the signal line 29, and two further resistors R2 and R3, respectively, which are connected to ground or to an opposing potential, are connected upstream and downstream of the resistor R1.

Figure 6:
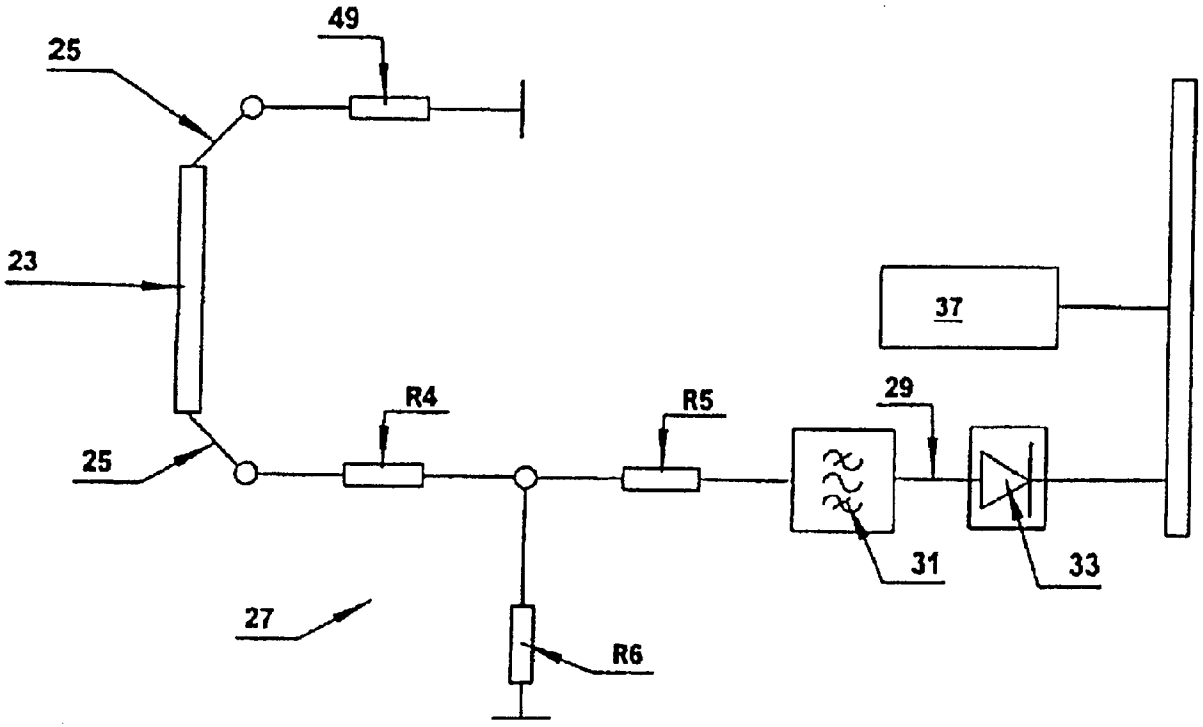
FIG. 6: shows a circuit arrangement, modified from that shown in FIG. 5, for a single-armed directional coupler, in which one output of the directional coupler is connected via a terminating resistor, and an attenuation element in the form of a T is provided instead of an attenuation element in the form of a Π at the other output.

As is also shown in FIG. 6, an attenuation circuit in the form of a T can be used instead of an attenuation circuit 27 in the form of a Π such as this, in which two resistors R4 and R5 are connected in series in the signal line 29, and a resistor R6 which is connected to ground or to an opposing potential is connected between them.

Alternatively, other attenuation circuits are in principle feasible (for example fixed attenuation elements).

As can be seen from the exemplary embodiment illustrated in FIG. 5, the electronic RF components for the upper face of the coupling are chosen and arranged so that they are identical and symmetrical for both coupling arms. Since any disturbance influences such as mismatches, component tolerances and temperature drifts act equally on both coupling arms, these influences cancel one another out.

The plan view in FIG. 5 also shows that a filter 31 as well as a level detector 33, for example, and an EEPROM 37 can also be accommodated in the two coupling arms A, B downstream from the attenuation circuits 27, with the transfer function of the two coupling arms together with an electronic evaluation preferably being stored in the EEPROM memory module.

Figure 4:
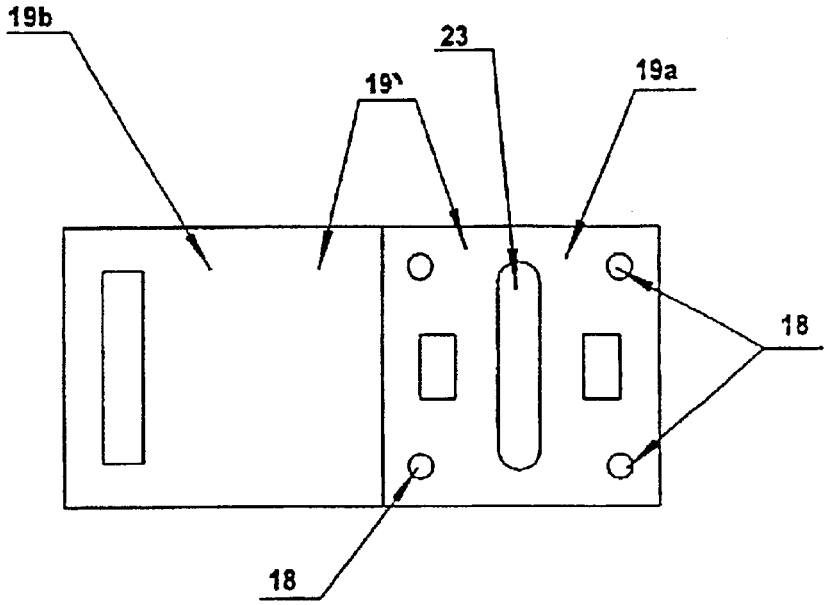
FIG. 4: shows an enlarged detailed illustration of the base plate, which comprises the coupling piece as well as the electronic assemblies and components, of the directional coupler including an extension section.

The entire arrangement, including an interface device 35, can be accommodated on the coupling substrate 19'. If the central section 19*a* of the coupling conductor substrate 19' is not large enough for the electronic components, then the coupler substrate 19' may also have an extension section 19*b*, which projects further at the sides, in addition to the central section 19*a* which is located immediately above the free cutout 15 on the outer conductor 3 of the coaxial line piece 1 (FIG. 4).

A mating plug device or contact device 36 can now be connected by means of an unshielded cable to said interface device 35, in order to tap off the analog signals, for example an unshielded ribbon cable 41, which leads to an externally accommodated microprocessor module 43.

In the illustrated exemplary embodiment, the coupler substrate 19' is a multilayer substrate with four layers, so that it is possible to produce a combination of an RF directional coupler and electronic evaluation on a single compact assembly. In this case, there are two internal layers, with the lower internal layer being used as a reference ground for the coupling line piece. However, the layer structure of the coupler substrate may also be configured differently, for example with a different substrate thickness or number of layers. The printed circuit board substrate may change for each layer, and may thus also have different quality levels and price classes.

FIG. 6 will be used firstly to show that the attenuation elements 27 may also be in the form of the T circuit that has been mentioned. Furthermore, FIG. 6 illustrates a directional coupler which has only one arm. In this case, the one coupling arm on the coupler substrate 19' is terminated by a terminating resistor 49.

In addition to the exemplary embodiments which have been explained, it should be noted that both the length and the width of the coupling line piece can be varied, and it may also in this case be mounted in a different relative position, that is to say in particular a different rotation position with respect to the inner conductor located underneath. In this case, the coupling line piece need not be in the form of a stripline. In fact, it may also be a wire clip, or may be in the form of a wired component (resistor).

As has already been indicated, the position and the configuration of the coupler substrate may be formed differently to the position and configuration in the illustrated exemplary embodiments. For example, different substrate thicknesses or a coupler substrate with a different position and a different number of layers from those in the illustrated exemplary embodiment can thus be used.

Finally, the printed circuit board substrate may also be formed from different quality levels and price classes.

As can be seen in particular by reference to FIGS. 4 and 5, the electrical and electronic components may be fitted not only on the upper face of the coupler, that is to say the upper face of the coupler substrate 19', but also on the lower face. Finally, the assemblies which have been described may also include elements for temperature compensation which allow, for example, software or hardware temperature compensation.

Furthermore, in addition to absolute level information, the assembly on the coupler substrate may also supply difference values for the level and phase between the two coupling arms. These signals can also be evaluated appropriately, and can be made available to a downstream microprocessor via the flat ribbon cable.

Finally, the two coupling arms a and b can be evaluated via separate or common electronic paths 29. Frequency-governing elements such as bandpass filters 31 or bandstop filters can be implemented in the evaluation paths, in order to suppress interference frequencies.

Finally, an additional circuit or a microprocessor may also be provided on the assembly, to evaluate the detector voltages obtained and, derived from them, to produce variables such as the reflection factor, return loss or standing wave ratio (VSWR). It may be necessary for the coupler substrate to be larger or to have a larger coupling attachment 19*b*.

What is claimed is:

1. Directional coupler having at least one coupling line piece which is coupled to a coaxial inner conductor of coaxial line pieces and, for this purpose, the coupling line piece is provided on or adjacent to a coupler substrate which is arranged on a resting or mounting section of an outer conductor of the coaxial line piece in a region of a cutout in the outer conductor, and the coupling line piece is in this way held in a space between the inner conductor and the outer conductor, comprising:

an attenuation circuit adjacent and connected to each of the two coupling line ends on the coupler substrate, or an attenuation circuit connected to one coupling line end with a terminating resistor being connected to the other coupling line end on the coupler substrate, an electrical level evaluation circuit device provided on the coupler substrate, and an interface device for connection of possibly unshielded cables provided on the coupler substrate, or possibly unshielded cables are connected to the level evaluation circuit device or connected downstream from the level evaluation circuit device on the coupler substrate, via which the RF signals which are obtained via the coupling line piece can be passed on in the form of analog AF signals.

2. Directional coupler according to claim 1, characterized in that the attenuation circuit is in the form of a Π circuit.

3. Directional coupler according to claim 1, characterized in that the attenuation circuit is in the form of a T circuit.

4. Directional coupler according to claim 1, characterized in that a level detector is provided on the coupler substrate, preferably adjacent to or downstream from each of the two coupling line ends.

5. Directional coupler according to claim 1, characterized in that a memory module which is preferably in the form of an EEPROM memory module is also provided on the coupler substrate and is used to store the transfer function of at least one and preferably both coupling arms, and of electronic evaluation.

6. Directional coupler according to claim 1, characterized in that the coupler substrate (19') has a multilayer structure.

7. Directional coupler according to claim 1, characterized in that the coupler substrate has a central section in the region of the exposed cutout in the outer conductor in the coaxial line piece, and in that an additional extension section is provided at least in a lateral direction from this central section, for holding further electrical or electronic components.

8. Directional coupler according to claim 1, characterized in that the coupling line piece is in the form of a stripline, a wire clip or a wired component, preferably in the form of a resistor.

9. Directional coupler according to claim 1, characterized in that the electrical level evaluation circuit device and interface device are fitted or provided on the upper face of the coupler substrate and/or on the lower face of the coupler substrate.

10. Directional coupler according to claim 1, characterized in that elements for temperature compensation are furthermore also provided on the coupler substrate.

11. Directional coupler according to claim 1, characterized in that, in addition to assemblies for detecting absolute level information, the directional coupler also has assemblies for detecting difference values for a level and phase between the two coupling arms.

12. Directional coupler according to claim 1, characterized in that components which determine a frequency, in particular bandpass filters or bandstop filters, are provided in at least one coupling arm, preferably in both coupling arms, in particular for suppressing interference frequencies.

13. Directional coupler according to claim 1, characterized in that the directional coupler preferably also has a microprocessor on the coupler substrate.

* * * * *